US006758529B2

(12) United States Patent
Parrott

(10) Patent No.: US 6,758,529 B2
(45) Date of Patent: Jul. 6, 2004

(54) MINING NOZZLE WITH TWO RING LATCH

(75) Inventor: George Albert Parrott, Barnsley (GB)

(73) Assignee: Minnovation Limited (GB)

( * ) Notice: Subject to any disclaimer, the term of this patent is extended or adjusted under 35 U.S.C. 154(b) by 193 days.

(21) Appl. No.: 10/006,013

(22) Filed: Dec. 4, 2001

(65) Prior Publication Data

US 2002/0066807 A1 Jun. 6, 2002

(30) Foreign Application Priority Data

Dec. 6, 2000 (GB) ..... 0029667

(51) Int. Cl.[7] ..... E21C 35/22; E21C 35/18
(52) U.S. Cl. ..... 299/81.3; 411/353; 239/600
(58) Field of Search ..... 285/321, 276; 411/352, 353, 517–519, 521; 239/600; 299/81.1, 81.2, 81.3, 17, 16

(56) References Cited

U.S. PATENT DOCUMENTS 4,046,405 A * 9/1977 Bonds ..... 285/321
5,718,459 A * 2/1998 Davie et al. ..... 285/321
6,062,149 A * 5/2000 Duvivier et al. ..... 108/158.11

FOREIGN PATENT DOCUMENTS

GB 2271792 4/1994
GB 2353486 2/2001

OTHER PUBLICATIONS

A copy of a Search Report dated Mar. 19, 2002, which issued in connection with corresponding British Patent Application No. 012892.4.

* cited by examiner

*Primary Examiner*—John Kreck
(74) *Attorney, Agent, or Firm*—Trexler, Bushnell, Giangiorgi, Blackstone & Marr, Ltd.

(57) ABSTRACT

An elongate water spray nozzle (8) for use with mining equipment, comprises a cylindrical body member (9) having a leading end (10) and a trailing end (11), with a circumferential groove (12) provided in the body member (9) towards the trailing end (11), the groove (12) housing firstly an inner, resiliently deformable 'O'-ring (13), and secondly an outer, split spring steel latching ring (14), the 'O'-ring (13) being resiliently operable on the steel ring (14) to bias the steel ring (14) concentrically with the longitudinal axis (15) of the nozzle (8). The invention also includes a pick box (6) provided with nozzles (8). The invention also includes a pick box provided with a nozzle (8), and a rotary cutting head provided with a plurality of such pick boxes.

17 Claims, 4 Drawing Sheets

MINING NOZZLE WITH TWO RING LATCH

RELATED/PRIORITY APPLICATION

This application claims priority with respect to British Application No. 0029667.3, filed Dec. 6, 2000.

FIELD OF THE INVENTION

This invention relates to a water spray nozzle, to a pick box provided with such a nozzle, and to a rotary cutting head provided with a plurality of such pick boxes.

BACKGROUND OF THE INVENTION

Water spray nozzles are conventionally provided on mining equipment for a variety of well known reasons. One known arrangement is a so-called rear entry nozzle whereby a receiving socket is provided in the pick box, and a nozzle is insertable into, and removable from, the rear of the pick box, (having regard to the direction of rotation of the rotary cutting head to which pick boxes are welded), and with a view to avoiding a screw threaded fastening of the nozzle to the pick box, which is difficult to insert and remove in mine conditions, and is subject to rusting, various "screwless" systems have been developed. One incorporates a circumferential groove intended to house a compressible split ring of spring steel, which after compression (by riding along inclined or chamfered surfaces) expands to latch the nozzle in place. However, due to the need to ensure that the dimensions of the groove are sufficient to accommodate compression of the steel ring, it is not unknown for the free ends of the steel ring to become displaced from the circumferential groove, with resultant loss of concentricity between the steel ring and the nozzle.

OBJECT OF THE INVENTION

A basic object of the invention is the provision of an improved nozzle, pick box, and rotary cutting head.

SUMMARY OF THE FIRST ASPECT OF THE INVENTION

According to a first aspect of the invention, there is provided an elongate water spray nozzle for use with mining equipment, comprising a cylindrical body member having a leading end and a trailing end, with a circumferential groove provided in the body member towards the trailing end, the groove housing firstly an inner, resiliently deformable 'O'-ring, and secondly an outer, split spring steel latching ring, the 'O'-ring being resiliently operable on the steel ring to bias the steel ring concentrically with the longitudinal axis of the nozzle.

SUMMARY OF A SECOND ASPECT OF THE INVENTION

According to a second aspect of the invention, there is provided a pick box having a socket in which is housed a water spray nozzle in accordance with the first aspect.

SUMMARY OF A THIRD ASPECT OF THE INVENTION

According to a third aspect of the invention, there is provided a rotary cutting head provided with a plurality of pick boxes in accordance with the second aspect.

ADVANTAGE(S) OF THE INVENTION

The invention thus provides a nozzle in which the steel ring is always retained in a concentric position with respect to the nozzle as a result of the bias of the 'O'-ring, whilst the 'O'-ring is itself compressible by the steel ring, during fitting and removal of a nozzle to and from its socket, thereby presenting no obstruction to compression of the steel ring and hence no adverse effect on the ability of an operator to latch the nozzle in its socket or to unlatch the nozzle for removal from its socket.

PREFERRED OF OPTIONAL FEATURES

The leading end of the nozzle is frusto-conical.

The leading end of the nozzle has a water discharge aperture.

The body member has a water delivery bore leading to the discharge aperture.

The body member has at least one radial water inlet bone leading to the delivery bore.

The body member is provided with a necked portion over a water inlet zone.

A cylindrical filter gauze is mounted on the necked portion.

A circumferential groove is provided beyond both the forward end and the rearward end of the necked portion, each groove housing a water sealing ring, to confine water to the water inlet zone, so as to ensure that the nozzle is balanced, so that there is no water pressure on the nozzle tending to eject it from its socket. Consequently, the latching effect of the steel split ring need only be such as to ensure mechanical retention of the nozzle within its socket.

A mechanical safety latch is provided to restrain uncontrolled ejection of the nozzle from its socket under the influence of water pressure, in the event of failure of the water ring in forward groove.

Adjacent the trailing end of the nozzle is an extraction groove, for engagement by a screw driver blade etc to urge the nozzle rearwardly resulting in compression of the steel ring and 'O'-ring permitting removal of the nozzle.

SUMMARY OF A FOURTH ASPECT OF THE INVENTION

According to a fourth aspect of the invention, of independent significance, there is provided a pick box having a socket adapted to receive a water spray nozzle of the so-called rear entry type, comprising a cylindrical body member having a leading end and a trailing end, with a circumferential groove provided in the body member towards the trailing end, the groove housing firstly an inner, resiliently deformable 'O'-ring, and secondly an outer, split spring steel latching ring, the 'O'-ring being resiliently operable on the steel ring to bias the steel ring concentrically with the longitudinal axis of the nozzle, the socket having a forward end through which, in use, a water spray may be emitted, and a rearward end, wherein the rearward end is counterbored and tapped, into which is screwed a replaceable retainer sleeve incorporating a first inclined surface at an outer mouth of the retainer sleeve for gradual compression of the steel ring and its 'O'-ring, until an internal step of the retainer sleeve is reached with an increase in diameter after the step permitting radial expansion of the steel ring, and partial or complete decompression of the 'O'-ring, to latch the nozzle in place, with the step providing second inclined surface along which the steel ring is adapted to ride, during nozzle extraction.

ADVANTAGE(S) OF THE FOURTH ASPECT

The provision of a retainer sleeve means that not only can a damaged or worn retainer sleeve be replaced without having to unweld the pick box from its rotary cutting head, but existing constructions of pick boxes may be converted to those of the fourth aspect.

PREFERRED FEATURE(S) OF THE FOURTH ASPECT

The retainer sleeve is of non-ferrous material such as brass, or synthetic plastics material such as nylon, so avoiding rusting of a steel insert screwed into a steel housing.

In one embodiment the retainer sleeve is provided with an external collar adapted to seat on an annular periphery of the box adjacent the nozzle receiving socket, and hence to limit the penetration of the retainer sleeve into the counterbore.

The collar is of hexagon profile so that it may be tightened, or untightened, by a spanner.

In another embodiment, no collar is provided and the insert is a flush fit.

The flush nozzle has a diametrical slot, so that it may be tightened, and untightened, by a screwdriver.

DRAWINGS

One embodiment of nozzle and pick box is shown by way of example in the accompanying drawings, in which.

Figure 2:
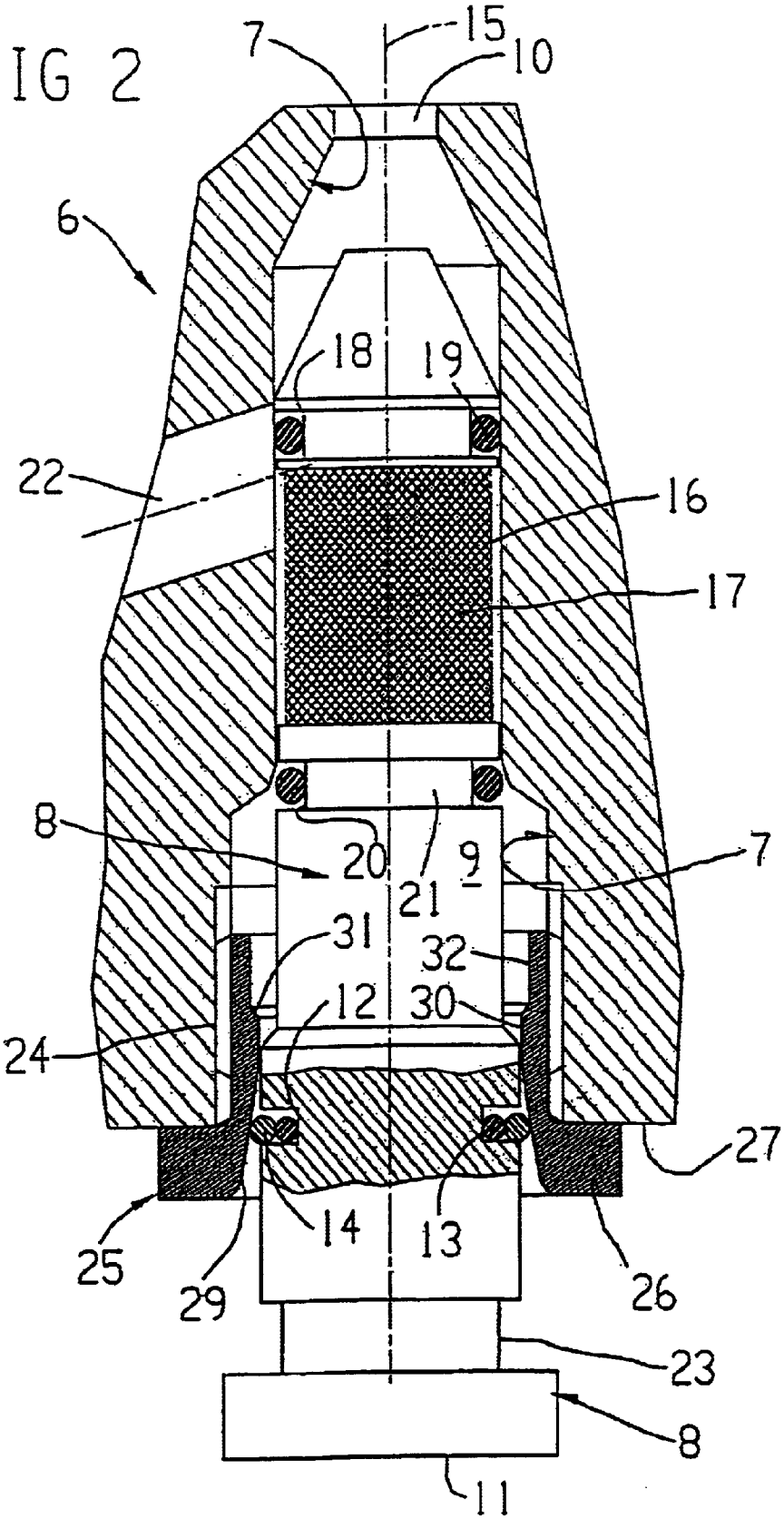
FIG. 2 shows, to a larger scale the nozzle of FIG. 1 partially inserted (or partially removed) from its receiving socket in the pick box.
Figure 3:
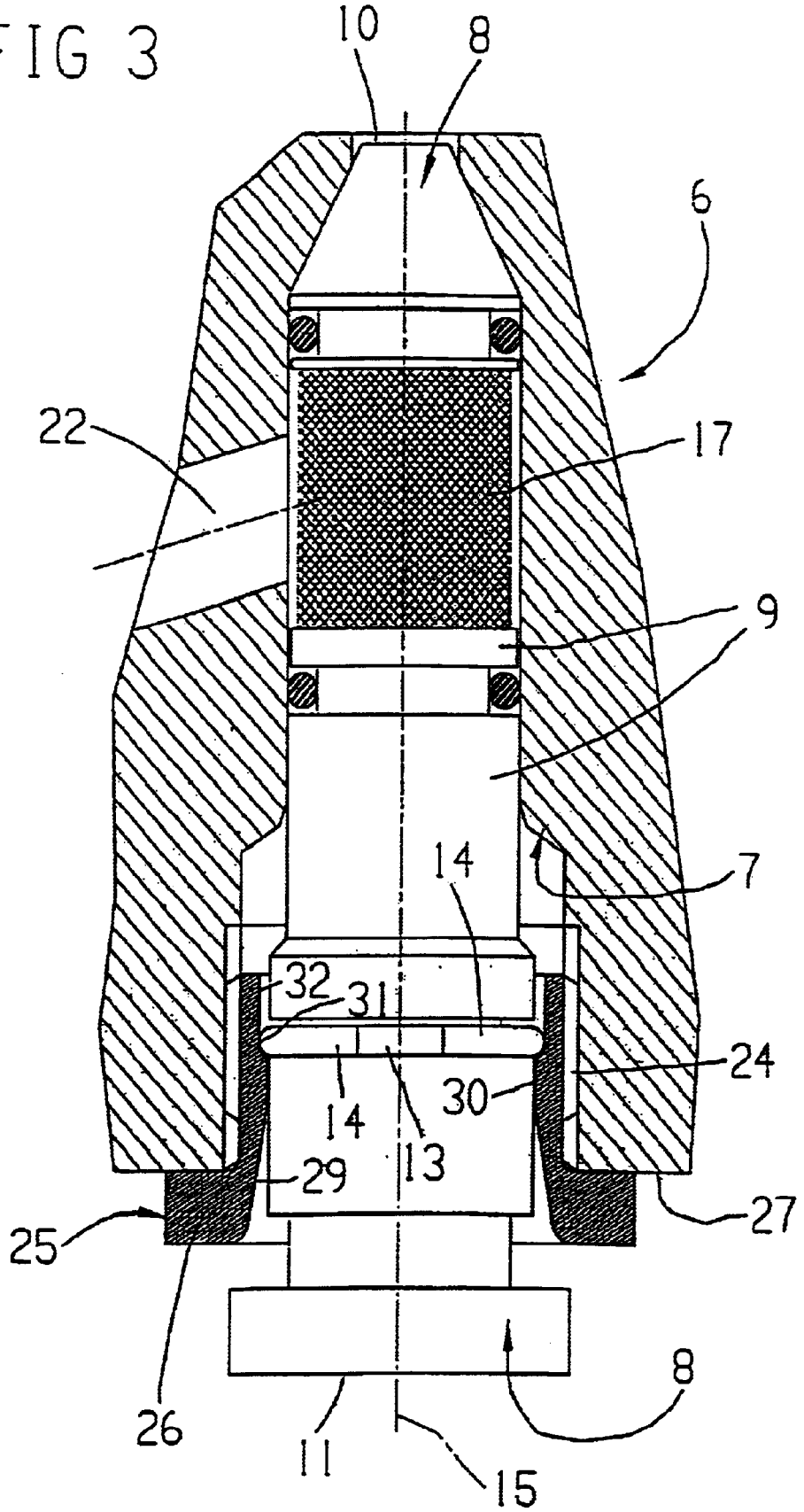

FIG. 3 corresponds to FIG. 2, but shows the nozzle fully inserted; and

Figure 4:
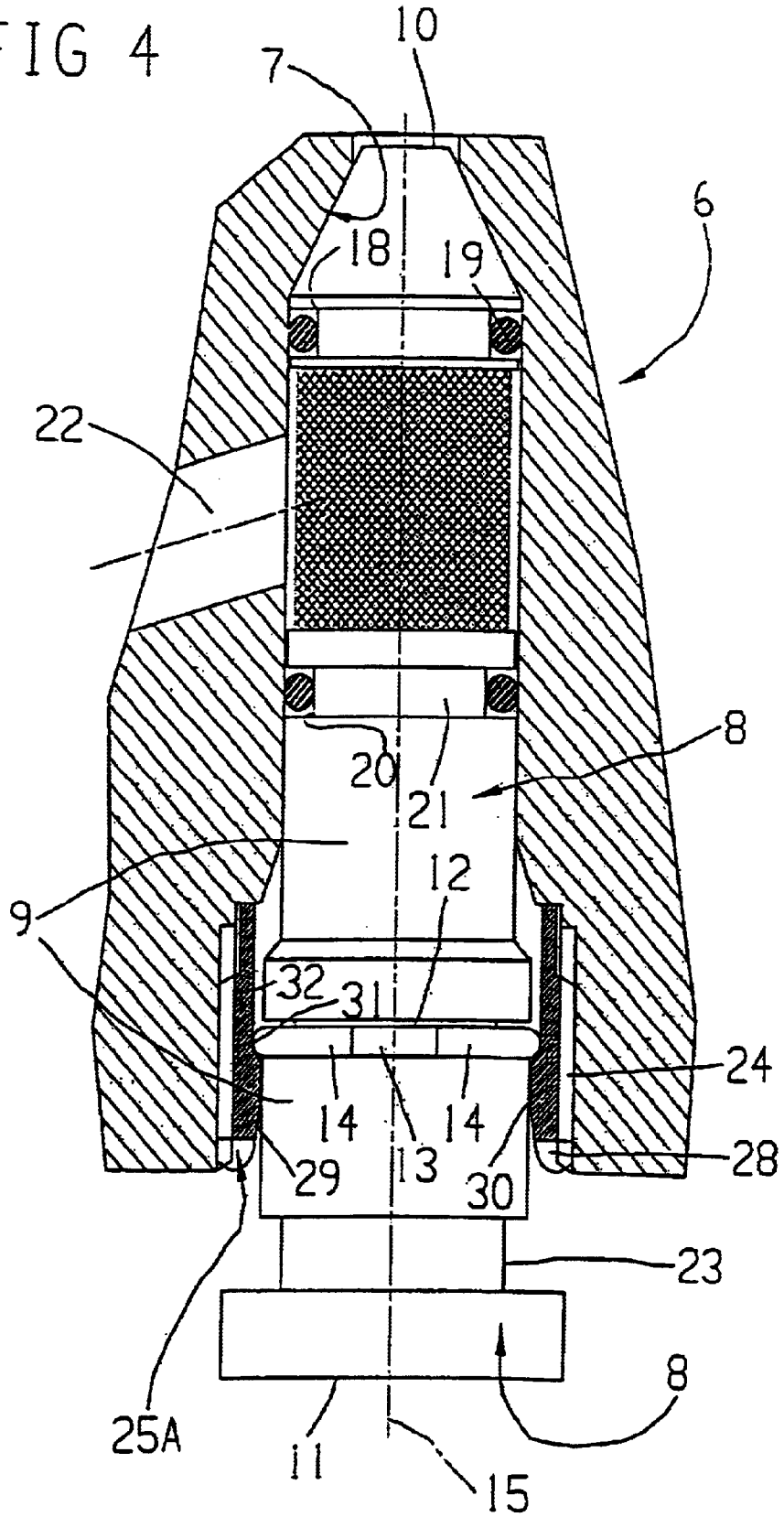

FIG. 4 corresponds to FIG. 3 but shows an alternative embodiment of retainer sleeve.

In the drawings, a pick 1 has an enlarged head 2 provided with a hard material cutting tip 3, and is provided with a shoulder 4 to abut a seating surface 5 of a pick box 6, the latter being provided, in the known manner, with an aperture to receive, releasably, an integral shank of the pick 1, with a means of latching the pick to the box.

The box 6 is also provided with a socket 7 to receive a water spray nozzle 8, best seen in a first embodiment in FIGS. 2 and 3, and in a second embodiment in FIG. 4.

The nozzle 8 comprises a cylindrical body member 9 having a leading, frusto-conical end 10 with a water discharge aperture, and a trailing end 11. A circumferential groove 12 is provided in the body member 9 towards the trailing end 11, in which groove 12 is housed firstly an inner, resiliently deformable 'O'-ring 13 and secondly an outer, split steel latching ring 14, with the 'O'-ring 13 being resiliently operable on the steel ring 14 to bias the steel ring to a concentric location with longitudinal axis 15 of the nozzle.

In a known manner, the body member 9 has an internal, axially extending water delivery bore leading to the discharge aperture, with at least one radial bore supplying the delivery bore. Also in a known manner, the body member 9 is provided with a necked portion 16 extending over a water delivery zone of the nozzle 8, with a cylindrical filter gauze 17 mounted on the necked portion 16, while a circumferential groove 18 housing a water sealing ring 19 is provided at one end of the necked portion 16, and a circumferential groove 20 housing a sealing ring 21 is provided at the other end of the necked portion 16. The pick box 6 is provided with a water supply bore 22 emerging within the socket 7 in the water delivery zone of the nozzle ie between the sealing rings 19 and 21. An extraction groove 23 for engagement by a screwdriver blade etc is provided adjacent the trailing end 11, to extract the nozzle 8 from its socket 7.

Figure 1:
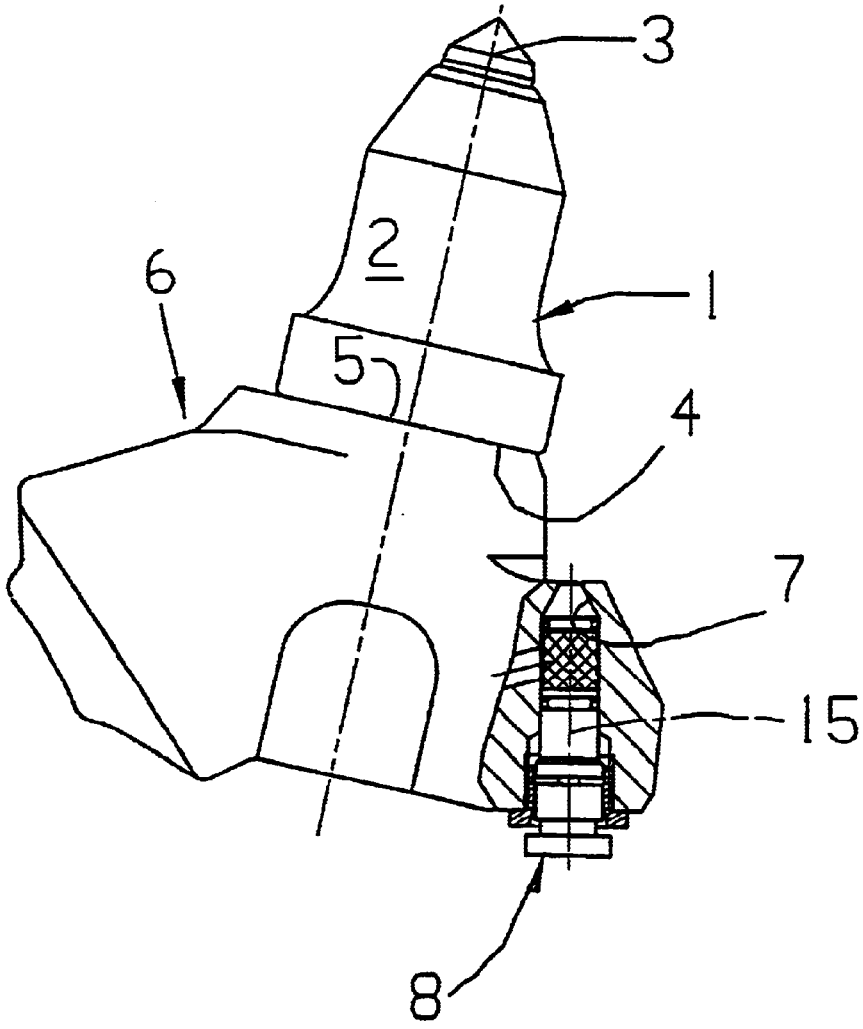
FIG. 1 is a part sectional side elevation of a pick box in accordance with the second aspect housing a nozzle, in accordance with the first aspect.

In accordance with the fourth aspect of the invention, the rearward end of the socket 7 is counterbored and tapped at 24 to receive a screwed-in, replaceable retainer sleeve 25. In the embodiment of FIGS. 1–3, the retainer sleeve 25 has an external collar 26 adapted to seat on the periphery 27 of the pick box 9 and of hexagonal profile for engagement by a spanner, while in the embodiment of FIG. 4, retainer sleeve 25A is a flush fit having a cross cut 28 for engagement by a screwdriver blade for screwing the sleeve 25A into, and out of, the socket 7.

The retainer sleeve 25, 25A has a first inclined surface 29 leading to a constant diameter portion 30 leading to an inclined step 31 leading to an enlarged diameter portion 32.

In FIG. 2 the nozzle 8 is shown in the partially inserted, or partially removed, position, while in FIG. 3, the nozzle 8 is shown in the fully inserted position.

As can be appreciated from FIG. 2, during insertion of the nozzle 8, the steel ring 14 rides along the first inclined surface 29 and is gradually compressed, thereby compressing the 'O'-ring 13, both rings in the fully compressed condition, passing along the constant diameter portion 30 until the step 31 is reached, when the resilience of the rings expands them into the larger diameter portion 32, thereby latching the nozzle 8 within its socket 7.

It follows that to remove a nozzle 8, the extraction groove 23 is engaged by a screwdriver blade etc, and the inclined step 31 compresses the rings 13, 14 to permit extraction.

What I claim is:

1. An elongate water spray nozzle having a longitudinal axis, for use with mining equipment, comprising a cylindrical body member having a leading end and a trailing end, with a circumferential groove provided in said body member towards said trailing end, said groove housing firstly an inner, resiliently deformable 'O'-ring, and housing secondly an outer, split spring steel latching ring, said 'O'-ring being resiliently operable on said steel ring to bias said steel ring concentrically with said longitudinal axis of said nozzle.

2. A nozzle as claimed in claim 1, wherein said leading end of said nozzle is frusto-conical.

3. A nozzle as claimed in claim 1, wherein said leading end of said nozzle has a water discharge aperture.

4. A nozzle as claimed in claim 3, wherein said body member has a water delivery bore leading to said water discharge aperture.

5. A nozzle as claimed in claim 4, wherein said body member has at least one radial water inlet bore leading to said water delivery bore.

6. A nozzle as claimed in claim 1, wherein said body member is provided with a necked portion over a water inlet zone.

7. A nozzle as claimed in claim 6, wherein a cylindrical filter gauze is mounted on said necked portion.

8. A nozzle as claimed in claim 6, wherein a forward circumferential groove and a rearward circumferential groove are provided beyond both a forward end and a rearward end of said necked portion, each of said grooves housing a water sealing ring, to confine water to said water inlet zone.

9. A nozzle as claimed in claim 1, wherein an extraction groove is provided adjacent said trailing end of said nozzle, for engagement by a screw driver blade etc to urge said nozzle rearwardly resulting in compression of said steel ring and said 'O'-ring permitting extraction of said nozzle from a receiving socket.

10. A pick box having a socket in which is housed a water spray nozzle as defined in claim 1.

11. A rotary cutting head provided with a plurality of pick boxes as defined in claim 10.

12. A pick box having a sock et adapted to receive a water spray nozzle of the so-called rear entry type, comprising a cylindrical body member having a leading end and a trailing end, with a circumferential groove provided in said body member towards said trailing end, said groove housing firstly an inner, resiliently deformable 'O'-ring, and secondly an outer, split spring steel latching ring, said 'O'-ring being resiliently operable on said steel ring to bias said steel ring concentrically with said longitudinal axis of said nozzle, said socket having a forward end through which, in use, a water spray may be emitted, and a rearward end, wherein said rearward end is counterbored and tapped, into which is screwed a replaceable retainer sleeve incorporating a first inclined surface at an outer mouth of said retainer sleeve for gradual compression of said steel ring and of said 'O'-ring, until an internal step of said retainer sleeve is reached with an increase in diameter after said step permitting radial expansion of said steel ring, and partial or complete decompression of said 'O'-ring, to latch said nozzle in place, with said step providing second inclined surface along which said steel ring is adapted to ride, during nozzle extraction.

13. A pick box as claimed in claim 12, wherein said retainer sleeve is of non-ferrous material such as brass, or synthetic plastics material such as nylon.

14. A pick box as claimed in claim 12, wherein said retainer sleeve is provided with an external collar adapted to seat on an annular periphery of said pick box adjacent said nozzle receiving socket, and hence to limit the penetration of said retainer sleeve into said counterbore.

15. A pick box as claimed in claim 14, wherein said collar is of hexagon profile so that it may be tightened, or untightened, by a spanner.

16. A pick box as claimed in claim 12, wherein said retainer sleeve is a flush fit with said pick box.

17. A pick box as claimed in claim 16, wherein said flush nozzle has a diametrical slot, so that it may be tightened, and untightened, by a screwdriver.

* * * * *